US010189698B2

(12) United States Patent
Proper et al.

(10) Patent No.: US 10,189,698 B2
(45) Date of Patent: Jan. 29, 2019

(54) SYSTEMS AND METHODS FOR MONITORING AND CONTROLLING DISPENSER FLUID REFILL

(71) Applicant: GOJO Industries, Inc., Akron, OH (US)

(72) Inventors: Scott T. Proper, Stow, OH (US); Richard E. Corney, Akron, OH (US); Paul Brown, Parma, OH (US)

(73) Assignee: GOJO INDUSTRIES, INC., Akron, OH (US)

( * ) Notice: Subject to any disclaimer, the term of this patent is extended or adjusted under 35 U.S.C. 154(b) by 80 days.

(21) Appl. No.: 15/398,170

(22) Filed: Jan. 4, 2017

(65) Prior Publication Data

US 2017/0190563 A1 Jul. 6, 2017

Related U.S. Application Data

(60) Provisional application No. 62/274,982, filed on Jan. 5, 2016.

(51) Int. Cl.
*B67D 7/06* (2010.01)
*B67D 7/02* (2010.01)
(Continued)

(52) U.S. Cl.
CPC ..... *B67D 7/0294* (2013.01); *A47K 5/1217* (2013.01); *B67D 7/3245* (2013.01);
(Continued)

(58) Field of Classification Search
CPC ..... B67D 7/02; B67D 7/0294; B67D 7/3245; B67D 7/34; B67D 7/84; A47K 5/1217; A47K 2005/1218
See application file for complete search history.

(56) References Cited

U.S. PATENT DOCUMENTS 5,226,566 A * 7/1993 Brandenburg ..... A47K 5/1205 222/180
5,392,827 A * 2/1995 Yasso ..... B65B 3/30 141/192

(Continued)

OTHER PUBLICATIONS

International Search Report and Written Opinion from International Application No. PCT/US2017/012083 dated May 19, 2017.

(Continued)

*Primary Examiner* — Nicolas A Arnett
(74) *Attorney, Agent, or Firm* — Calfee, Halter & Griswold LLP

(57) ABSTRACT

A counter mountable fluid dispenser includes a below deck assembly and an above deck assembly. The below deck assembly includes a reservoir for storing a fluid, a dispensing mechanism in fluid communication with the reservoir, and a controller in circuit communication with the dispensing mechanism for operation of the dispensing mechanism. The above deck assembly includes a spout defining an outlet port in fluid communication with the reservoir for dispensing fluid stored in the reservoir upon operation of the dispensing mechanism, an external supply port in fluid communication with the reservoir by a supply passage to supply fluid to the reservoir, an access door movable between a closed position blocking access to the external supply port and an open position permitting access to the external supply port, and a switch mechanism configured to disable the dispensing mechanism when the access door is in the open position.

20 Claims, 13 Drawing Sheets

(51) Int. Cl.

| | |
|---|---|
| ***B67D 7/84*** | (2010.01) |
| ***B67D 7/32*** | (2010.01) |
| ***B67D 7/34*** | (2010.01) |
| ***A47K 5/12*** | (2006.01) |

(52) U.S. Cl.
CPC ..... *B67D 7/34* (2013.01); *B67D 7/84* (2013.01); *A47K 2005/1218* (2013.01)

(56) References Cited

U.S. PATENT DOCUMENTS 5,540,362 A 7/1996 Azuma et al.
5,632,414 A * 5/1997 Merriweather, Jr. ..... A47K 5/1205 222/180
6,142,342 A * 11/2000 Lewis ..... A47K 5/1205 222/180
6,345,738 B1 2/2002 Brozell et al.
6,467,651 B1 * 10/2002 Muderlak ..... A47K 5/1217 222/333
6,651,851 B2 * 11/2003 Muderlak ..... A47K 5/1217 222/333
6,929,150 B2 * 8/2005 Muderlak ..... A47K 5/1217 222/1
7,228,874 B2 * 6/2007 Bolderheij ..... E03C 1/04 137/801
7,364,053 B2 * 4/2008 Ophardt ..... A47K 5/16 137/801
7,533,787 B2 * 5/2009 Muderlak ..... A47K 5/1217 222/333
7,611,317 B2 * 11/2009 Muderlak ..... A47K 5/1217 222/333
7,647,653 B1 * 1/2010 Catania ..... A47K 5/1202 4/628
7,798,370 B2 * 9/2010 Ciavarella ..... A47K 5/1204 222/153.09
7,815,074 B2 * 10/2010 Ciavarella ..... A47K 5/12 141/383
7,950,548 B2 * 5/2011 Ciavarella ..... A47K 5/1204 222/181.3
8,371,474 B2 * 2/2013 Tramontina ..... A47K 5/1205 222/1
8,579,157 B2 11/2013 Bem et al.
8,863,992 B2 * 10/2014 Wing ..... G01F 11/24 222/240
8,893,928 B2 * 11/2014 Proper ..... B67D 7/76 222/173
8,950,628 B2 * 2/2015 Muderlak ..... B05B 11/3052 222/135
9,437,103 B2 * 9/2016 Ophardt ..... A47K 5/1202
9,681,779 B2 * 6/2017 Babikian ..... A47K 5/1211
2002/0185500 A1 * 12/2002 Muderlak ..... A47K 5/1217 222/1
2004/0050876 A1 * 3/2004 Muderlak ..... A47K 5/1217 222/333
2005/0205612 A1 * 9/2005 Muderlak ..... A47K 5/1217 222/333
2005/0218161 A1 * 10/2005 Muderlak ..... A47K 5/1217 222/333
2006/0011655 A1 * 1/2006 Ophardt ..... A47K 5/16 222/190
2007/0204925 A1 * 9/2007 Bolderheij ..... E03C 1/04 137/801
2009/0084813 A1 * 4/2009 Chen ..... A47K 5/1217 222/52
2011/0127291 A1 * 6/2011 Tramontina ..... A47K 5/1205 222/52
2011/0215115 A1 * 9/2011 Proper ..... B67D 7/76 222/173
2013/0075420 A1 * 3/2013 Tramontina ..... A47K 5/1205 222/1
2014/0124540 A1 * 5/2014 Ciavarella ..... A47K 5/14 222/190
2014/0253336 A1 * 9/2014 Ophardt ..... A47K 5/1202 340/573.1
2014/0263421 A1 9/2014 Urban
2014/0263427 A1 * 9/2014 Muderlak ..... B05B 11/3052 222/52
2014/0263430 A1 9/2014 Keating
2015/0083748 A1 * 3/2015 McHale ..... E03C 1/057 222/52
2015/0230668 A1 8/2015 Shakkour
2016/0316975 A1 * 11/2016 Ophardt ..... A47K 5/1202
2017/0112329 A1 * 4/2017 Babikian ..... A47K 5/1217
2017/0190565 A1 * 7/2017 Proper ..... B67D 7/0294
2018/0078958 A1 * 3/2018 Ophardt ..... A47K 5/1211

OTHER PUBLICATIONS

Office Action for U.S. Appl. No. 15/211,582 dated Jan. 25, 2018.
Invitation to Pay Additional Fees for International Application No. PCT/US2017/012083 dated Mar. 13, 2017.

* cited by examiner

SYSTEMS AND METHODS FOR MONITORING AND CONTROLLING DISPENSER FLUID REFILL

CROSS-REFERENCE TO RELATED APPLICATION

This application claims priority to and the benefit of U.S. Provisional Patent Application Serial No. 62/274,982, entitled "SYSTEMS AND METHODS FOR MONITORING AND CONTROLLING DISPENSER FLUID REFILL" and filed Jan. 5, 2016, the entire disclosure of which is incorporated herein by reference.

BACKGROUND

Fluid dispensers are commonly used in restaurants, factories, hospitals, and public bathrooms. These dispensers may contain fluids such as soap, anti-bacterial cleansers, disinfectants, lotions and the like. Some dispensers utilize some type of manual pump actuation mechanism wherein the user pushes or pulls a lever to manually dispense a quantity of fluid into the user's hands. "Elands-free" dispensers may also be utilized wherein the user simply places their hand underneath or in front of a sensor and an electromechanical pump mechanism dispenses a metered quantity of fluid. Related types of dispensers may be used to dispense powder or aerosol materials.

In some embodiments, a dispenser includes a replaceable refill cartridge or container (e.g., a bag, pouch, or tank) that is installed within the dispenser housing or attached to the dispenser (e.g., below a countertop) and is connected to a pump mechanism and an outlet port for dispensing the contents of the container. When the fluid in the container is depleted, the container is detached from the pump mechanism and a new, filled container is installed and attached to the pump mechanism.

In other embodiments, a dispenser includes a more permanent container or reservoir into which additional fluid is poured from an external fluid source (e.g., an external bottle, bag, or other refill container). This arrangement may be preferred for dispensers for which access to the fluid source is inconvenient (e.g., countertop mounted dispensers that store fluid beneath the counter) or undesirable (e.g., dispensers for which user maintenance of the dispenser, such as disassembly and/or replacement of components, is preferably minimized), or to allow for refilling of the dispenser fluid container from a larger, more economical external refill container.

A variety of mechanical and electronic mechanisms have been utilized to prevent replacement of a depleted installed refill container with an unauthorized or incorrect refill container, for example, to ensure the correct type and quality fluid is being provided, or to limit the source of replacement fluid to approved manufacturers or distributors. Examples of such mechanisms include mechanically, magnetically, electromechanically, or electronically keyed arrangements that require the refill container to have a proper connector or identifier (e.g., magnetic, electromechanical, or electronic identifier) to assemble with and/or enable functioning of the dispenser. Despite these measures, tactics for improper or unauthorized refilling of a dispenser remain, including reuse of an authorized refill container by injection of refill fluid into the container (often referred to as "stuffing" or "drill and fill"). Dispenser systems that utilize an external refill container are generally even more vulnerable to refilling with unauthorized or incorrect fluids, as the fluid may be added through the external refill supply port or directly into the reservoir (e.g., "drill and fill").

SUMMARY

The present application contemplates inventive systems and methods for monitoring and/or controlling dispenser fluid refill operations, using either or both of a replaceable internal refill container and a connectable external refill container.

In an exemplary embodiment of the present application, a counter mountable fluid dispenser a below deck reservoir, an above deck spout, and an access panel. The spout includes an outlet port at a front portion of the spout, the outlet port being in fluid communication with the reservoir for dispensing fluid stored in the reservoir, and an external supply port at a rear portion of the spout, the external supply port being connected with the reservoir by a supply passage to supply fluid to the reservoir. The access panel is assembled with the spout to define an upper surface of the spout, and is slideable in a forward direction from a closed position blocking access to the external supply port and an open position permitting access to the external supply port.

In another exemplary embodiment of the present application, a counter mountable fluid dispenser includes a below deck assembly and an above deck assembly. The below deck assembly includes a reservoir for storing a fluid, a dispensing mechanism in fluid communication with the reservoir, and a controller in circuit communication with the dispensing mechanism for operation of the dispensing mechanism. The above deck assembly includes a spout defining an outlet port in fluid communication with the reservoir for dispensing fluid stored in the reservoir upon operation of the dispensing mechanism, an external supply port in fluid communication with the reservoir by a supply passage to supply fluid to the reservoir, an access door movable between a closed position blocking access to the external supply port and an open position permitting access to the external supply port, and a switch mechanism configured to disable the dispensing mechanism when the access door is in the open position.

In another exemplary embodiment of the present application, a fluid dispensing system includes a counter mountable fluid dispenser and an external refill container. The dispenser includes a below deck reservoir, an above deck spout, and an access door. The spout includes an outlet port at a front portion of the spout, the outlet port being in fluid communication with the reservoir for dispensing fluid stored in the reservoir, and an external supply port at a rear portion of the spout, with the external supply port including a quick disconnect socket connected with the reservoir by a supply passage to supply fluid to the reservoir. The access door is assembled with the spout, and is movable between a closed position blocking access to the external supply port and an open position permitting access to the external supply port. The external refill container includes a quick disconnect plug connectable with the quick disconnect socket. The spout includes a release button disposed on an outer surface of the spout, with the release button being depressible to disengage the quick disconnect plug from the quick disconnect socket.

In another exemplary embodiment of the present application, a fluid dispensing system includes a fluid dispenser and an external refill container for storing a refill fluid. The fluid dispenser includes a reservoir for storing a fluid, an outlet port in fluid communication with the reservoir for dispensing fluid stored in the reservoir, an external supply port connected with the reservoir by a supply passage to supply fluid to the reservoir, with the external supply port including a first connector, a supply access valve defining a portion of the supply passage between the supply port and the reservoir, and a controller in circuit communication with the supply access valve for controller operation of the supply access valve between a closed position and an open position. The external refill container includes a second connector connectable with the first connector, and a keying mechanism. When the second connector is connected with the first connector, the keying mechanism transmits an authorized supply signal to the controller to initiate controller operation of the supply access valve from the closed position to the open position.

In another exemplary embodiment of the present application, a fluid dispenser includes a reservoir for storing a fluid, an outlet port connected with the reservoir by a dispense passage for dispensing fluid stored in the reservoir, an external supply port connected with the reservoir by a supply passage to supply fluid to the reservoir, a supply access valve defining a portion of the supply passage between the external supply port and the reservoir, and a controller in circuit communication with the supply access valve for controller operation of the supply access valve from a closed position to an open position in response to receipt of an authorized supply signal at the controller.

In another exemplary embodiment of the present application, a fluid dispenser includes a reservoir for storing a fluid, an outlet port in fluid communication with the reservoir for dispensing fluid stored in the reservoir, a supply passage connected with the reservoir to permit a supplying of fluid to the reservoir when the supply passage is in an open condition and to block the supplying of fluid to the reservoir when the supply passage is in a closed condition, a controller configured to determine whether the supply passage is in the open condition or the closed condition, and a fill level sensor operable to measure a fluid fill level of the reservoir, the fill level sensor being in circuit communication with the controller to transmit to the controller a fill level data signal corresponding to the fluid fill level. The controller is further configured to generate an improper filling notification signal when the fill level data signal received from the fill level sensor indicates an increase in the fluid fill level of the reservoir in combination with the supply passage being in the closed condition.

In another exemplary embodiment of the present application, a fluid dispensing system includes a fluid dispenser and an external refill container. The fluid dispenser includes a reservoir for storing a fluid, an outlet port in fluid communication with the reservoir for dispensing fluid stored in the reservoir, an external supply port connected with the reservoir by a supply passage, with the external supply port including a first connector, a fill level sensor operable to measure a fluid fill level of the reservoir and to transmit a fill level data signal corresponding to the fluid fill level, and a controller in circuit communication with the fill level sensor for receiving the fill level data signal. The external refill container stores a refill fluid, and includes a second connector connectable with the first connector to supply the refill fluid to the reservoir, and a memory storage device storing refill level data corresponding to a previously measured fluid refill level of the external refill container. The memory storage device is in circuit communication with the controller, at least when the second connector is connected with the first connector, for transmitting the refill level data to the controller. The controller is further configured to generate an improper refilling notification signal when the fill level data signal indicates an increase in the fluid fill level of the reservoir that exceeds the fluid refill level of the external refill container.

In another exemplary embodiment of the present application, a method is contemplated for refilling a fluid dispenser including a reservoir for storing a fluid, an external supply port connected with the reservoir by a supply passage, a supply access valve defining a portion of the supply passage between the supply port and the reservoir, and a controller in circuit communication with the supply access valve. In the exemplary method, an external refill container storing a refill fluid is provided. A connector of the external refill container is connected with the external supply port of the dispenser. An authorized supply signal is transmitted from the external refill container to the controller. In response to receipt of the authorized supply signal, the controller is operated to move the supply access valve from a closed position to an open position to permit passage of the refill fluid from the external refill container to the reservoir.

In another exemplary embodiment of the present application, a method is contemplated for detecting improper refilling of a fluid dispenser including a reservoir, an outlet port in fluid communication with the reservoir, and a supply passage connected with the reservoir. In the exemplary method, a controller is used to determine whether the supply passage is in an open condition permitting a supplying of fluid to the reservoir or a closed position blocking the supplying of fluid to the reservoir. A fluid fill level of the reservoir is measured, and a fill level data signal corresponding to the fluid fill level is transmitted to the controller. The controller is operated to generate an improper filling notification signal when the fill level data signal indicates an increase in the fluid fill level of the reservoir in combination with the supply passage being in the closed condition.

In another exemplary embodiment of the present application, a method is contemplated for detecting improper refilling of a fluid dispenser having a reservoir for storing a fluid, an outlet port in fluid communication with the reservoir, and an external supply port connected with the reservoir by a supply passage. In the exemplary method, an external refill container storing a refill fluid is provided. Refill level data corresponding to a previously measured fluid refill level of the external refill container is transmitted from the external refill container to a controller when a connector of the external refill container is connected with the external supply port of the dispenser. A fluid fill level of the reservoir is measured, and a fill level data signal corresponding to the fluid fill level is transmitted to the controller. The controller is operated to generate an improper refilling notification signal when the fill level data signal indicates an increase in the fluid fill level of the reservoir that exceeds the fluid refill level of the external refill container.

BRIEF DESCRIPTION OF THE DRAWINGS

These and other features and advantages of the present invention will become better understood with regard to the following description and accompanying drawings in which.

DETAILED DESCRIPTION

Figure 1:
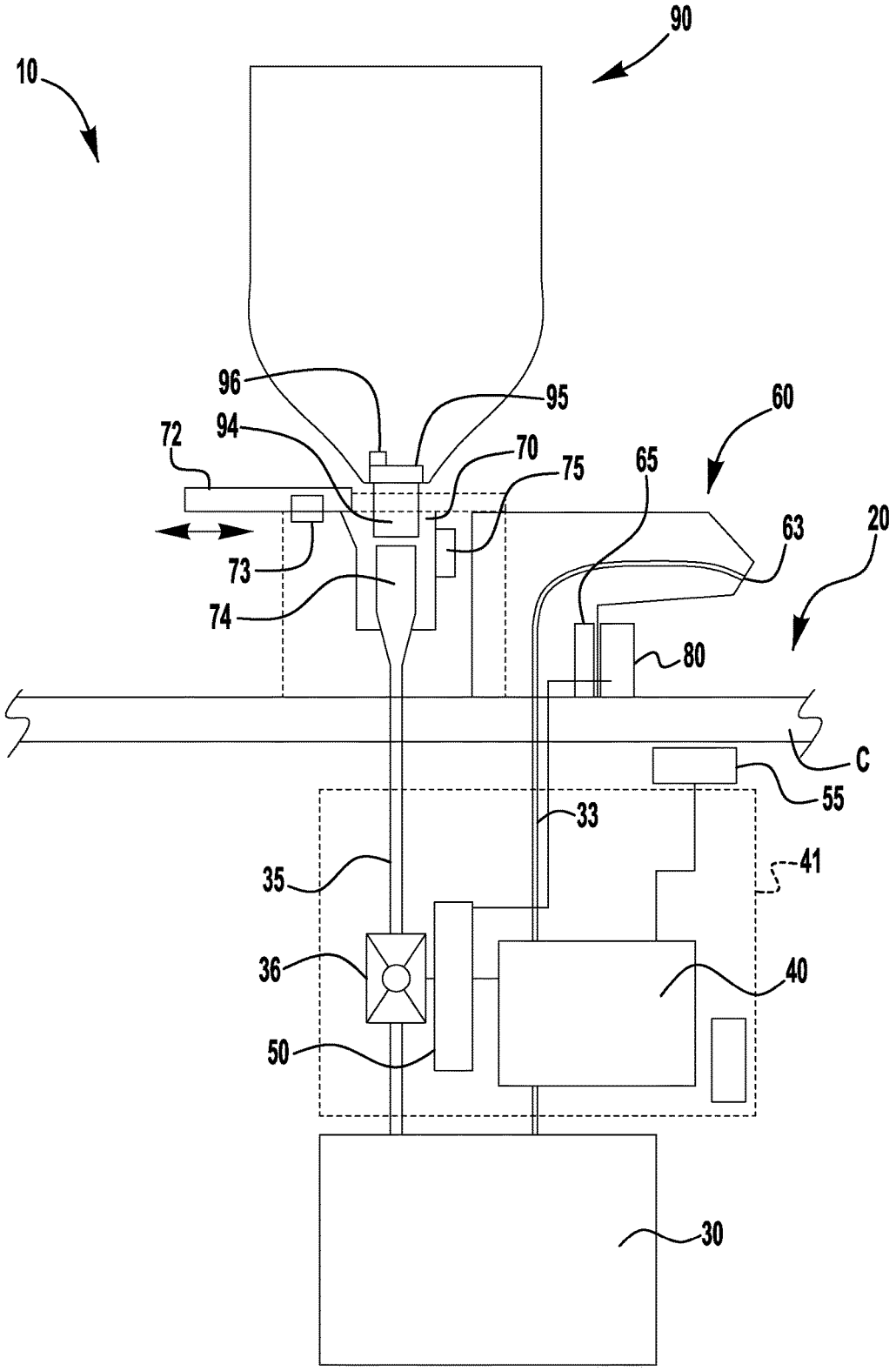
FIG. 1 is a schematic view of an externally filled fluid dispensing system, according to an exemplary embodiment.
Figure 2:
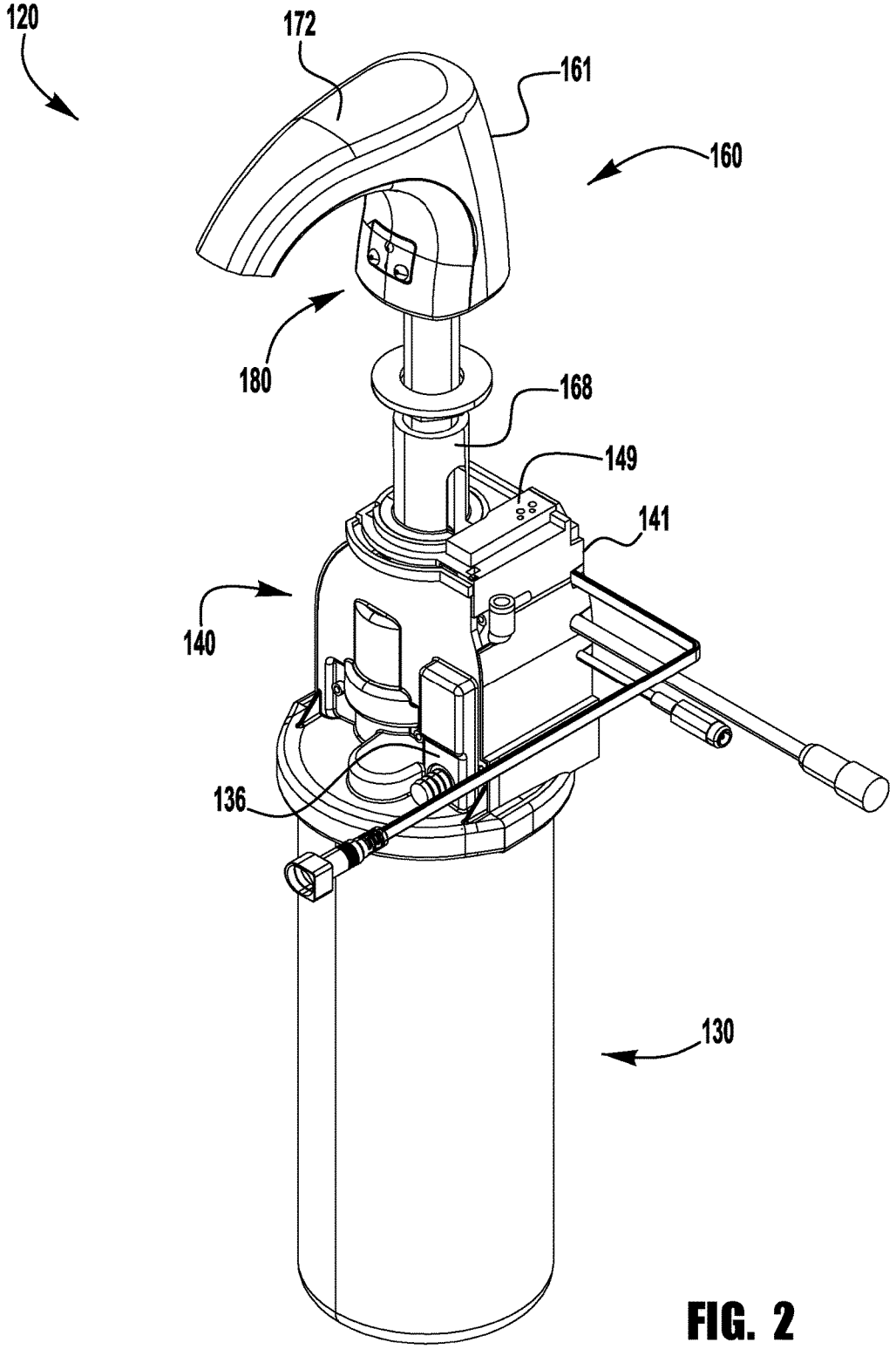
FIG. 2 is an upper perspective view of a counter mountable externally fillable fluid dispenser, according to an exemplary embodiment.
Figure 3:
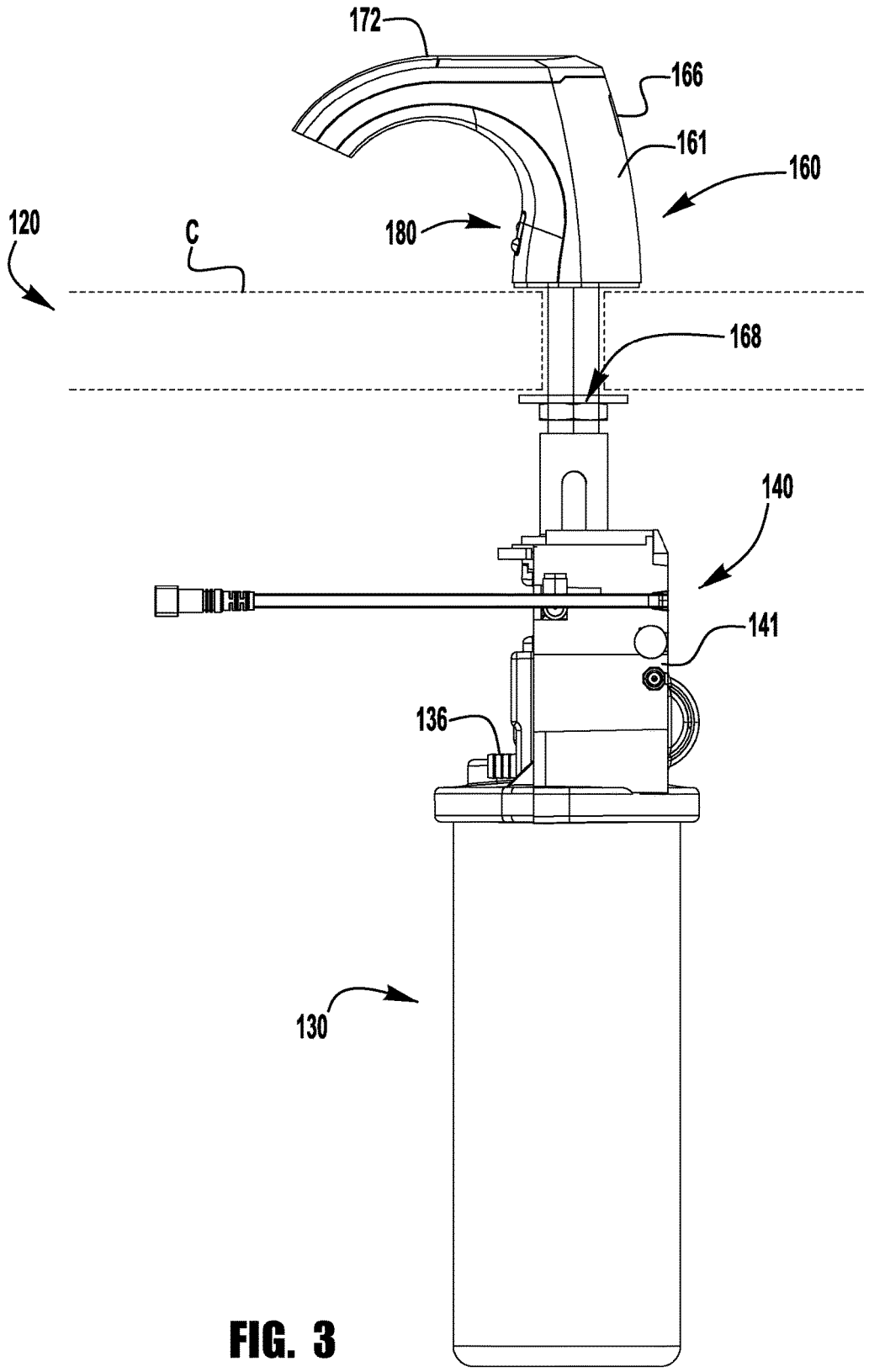
FIG. 3 is a side view of the fluid dispenser of FIG. 2.
Figure 4:
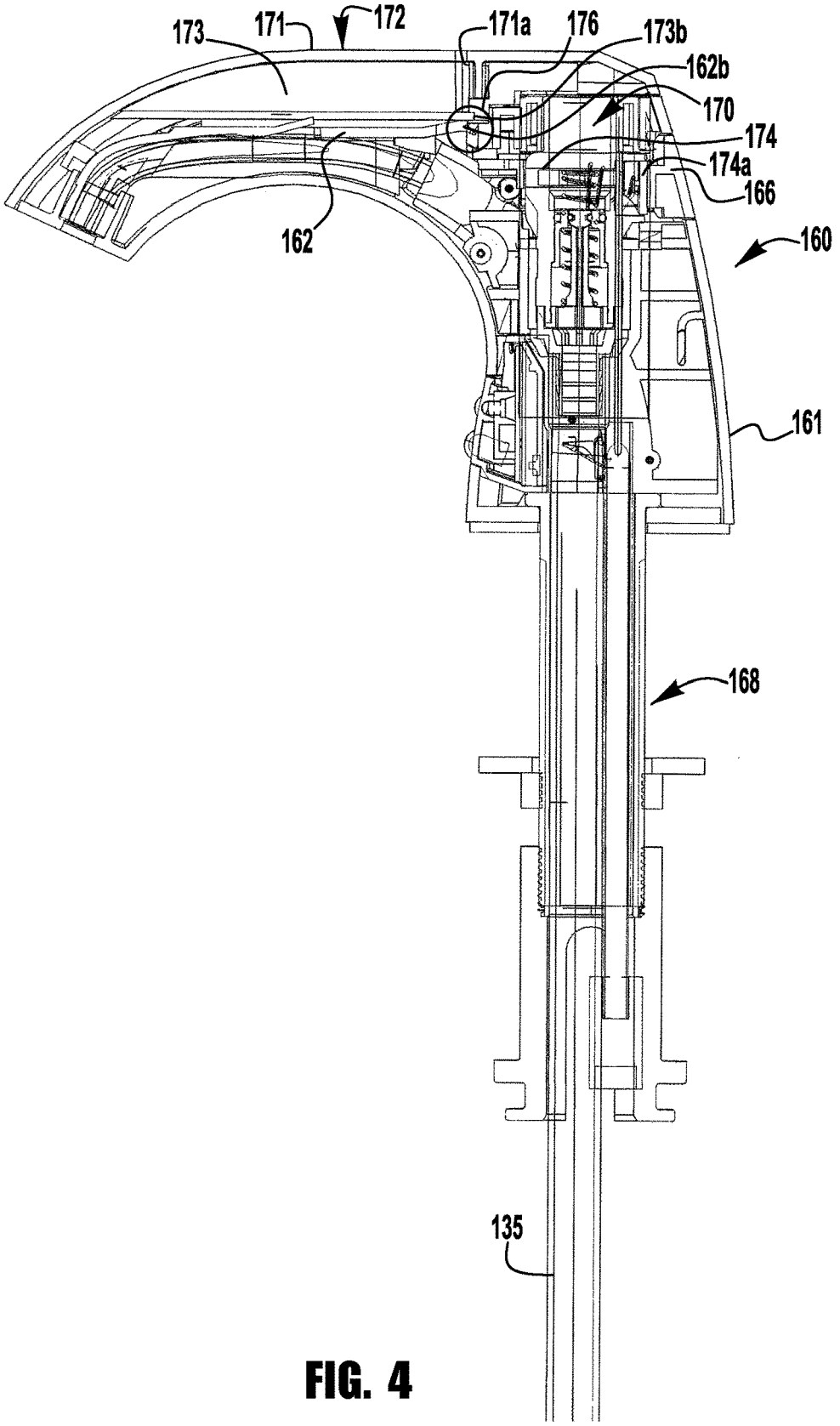
FIG. 4 is a side cross-sectional view of the upper spout portion of the fluid dispenser of FIG. 2.
Figure 5:
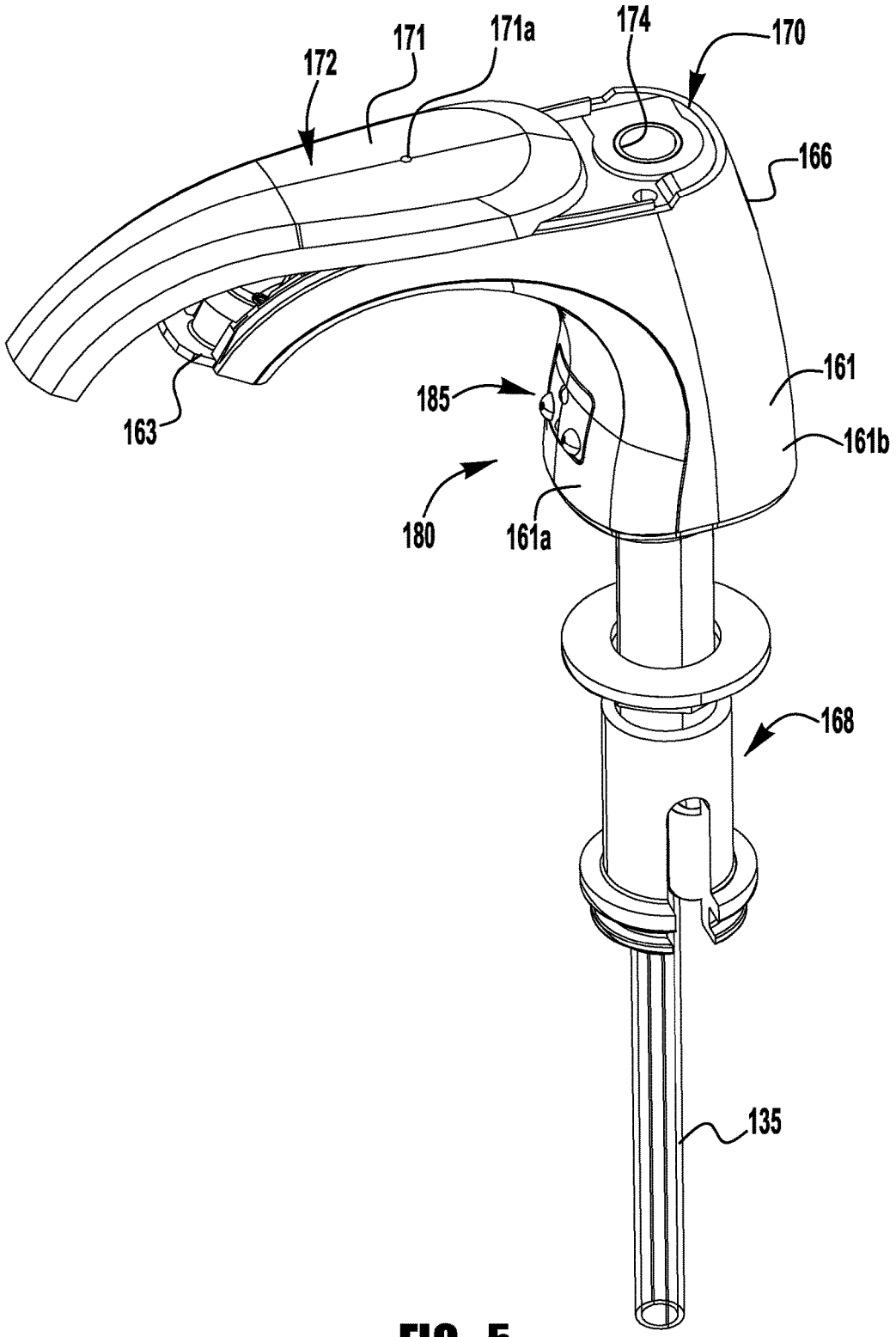
FIG. 5 is an upper perspective view of the upper spout portion of the fluid dispenser of FIG. 2, shown with the access door in an open position.
Figure 6:
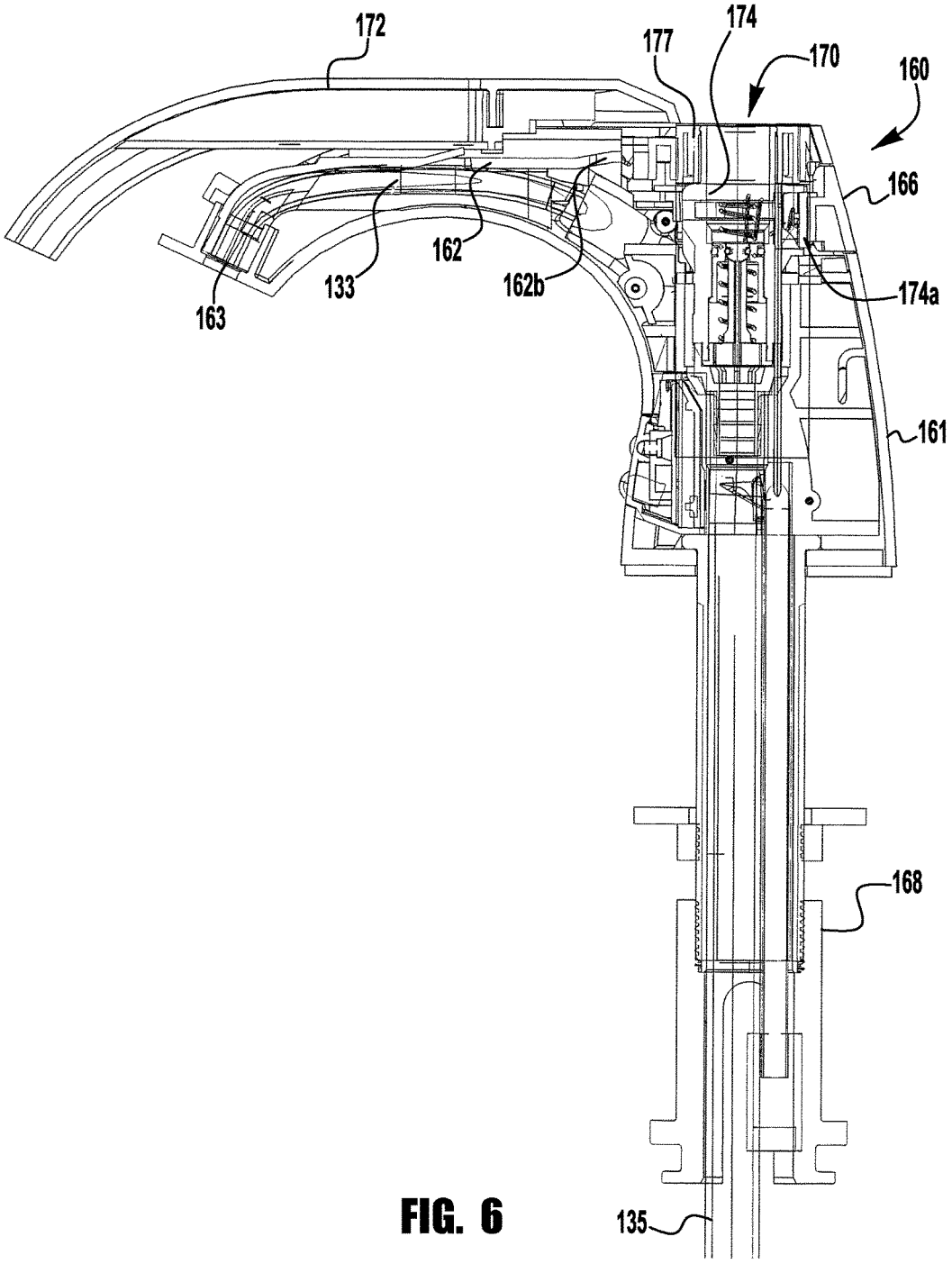
FIG. 6 is a side cross-sectional view of the upper spout portion of the fluid dispenser of FIG. 2, shown with the access door in an open position.

The Detailed Description merely describes exemplary embodiments of the invention and is not intended to limit the scope of the claims in any way. Indeed, the invention is broader than and unlimited by the exemplary embodiments, and the terms used in the claims have their full ordinary meaning.

Also, while certain exemplary embodiments described in the specification and illustrated in the drawings relate to externally filled counter-mounted fluid dispensers and external refill containers for hand hygiene applications, and systems and methods for monitoring and controlling external refilling of hand hygiene dispenser devices, it should be understood that many of the inventive features described herein may be applied to other devices, systems, and methods. For example, the features described herein may be utilized in other dispensing arrangements (e.g., internal refill cartridge based dispensers, wall mounted dispensers, stand mounted dispensers, standalone dispensers, tabletop dispensers, portable dispensers), dispensers for other types of fluids (e.g., sunscreen, pharmaceuticals), dispensers of solid materials (e.g., powders, particulate), and other types of containment devices.

"Circuit communication" indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication.

"Logic," as used herein, is synonymous with "circuit" or "circuitry" and includes, but is not limited to, hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

"Signal," includes, but is not limited to one or more electrical signals, analog or digital signals, one or more computer instructions, a bit or bit stream, or the like.

Any values identified in the detailed description are exemplary and they are determined as needed for a particular dispenser and/or refill design. Accordingly, the inventive concepts disclosed and claimed herein are not limited to the particular values or ranges of values used to describe the embodiments disclosed herein.

An exemplary aspect of the present application involves systems and methods for monitoring and controlling the refilling of a fluid dispenser, for example, to prevent filling the dispenser with improper or incorrect fluids, or by unauthorized individuals. In one such embodiment, an externally filled hand cleaning fluid dispenser is configured to monitor and control refilling of the fluid dispenser from an external refill container by identifying and/or preventing unauthorized or improper refill attempts. As used herein, an "externally filled fluid dispenser" includes any dispenser for which an internal reservoir is refilled by supplying fluid (e.g., from an external refill container) to an external supply port that is connected with or in fluid communication with the reservoir, as compared to a fluid dispenser that houses a replaceable or removable internal fluid refill container or cartridge, for which the fluid dispenser housing must be opened or removed for removal and replacement or refilling of the internal refill container. An externally filled fluid dispenser arrangement may be desirable for counter mounted dispensers having a spout or nozzle portion and external supply port mounted above a counter (or "above deck") and a fluid containing portion (e.g., reservoir) mounted below the counter (or "below deck"), for example, to eliminate the need for below-counter access to the dispenser for refilling.

FIG. 1 schematically illustrates an exemplary fluid dispensing system 10 including an externally filled fluid dispenser 20 and an external refill container 90. The exemplary dispenser 20 includes a below deck reservoir 30 and dispensing mechanism 40 (disposed in housing 41), an above deck spout or nozzle portion 60 having an outlet port 63 connected to the reservoir 30 by a dispense passage 33, and an external supply port 70 connected to the reservoir 30 by a supply passage 35. The dispensing mechanism 40 is operable to pump or otherwise facilitate the flow of fluid from the reservoir 30 through the dispense passage 33 to the outlet port 63 in response to user manipulation of a user interface (shown schematically at 80). The user interface may include any suitable manual, electromechanical, or electronic actuating mechanism, including, for example, a manually depressible hand bar or plunger, an electrical switch engaging button, or a "hands free" voice, optic, motion, or proximity sensor. In the schematically illustrated example, the dispenser 20 includes a controller 50 in circuit communication with an electronic user interface 80 (e.g., button or "hands free" sensor) and in circuit communication with a dispensing mechanism 40. When the controller 50 receives an actuation signal from the user interface 80, the controller initiates operation of the dispensing mechanism 40 to dispense fluid from the reservoir 30 through the dispense passage 33 to the outlet port 63.

While the external supply port may include an open port continuously accessible for refilling the reservoir (e.g., by pouring refill fluid directly into the external supply port from a bulk container), in some embodiments, it may be desirable to restrict access to the external supply port and/or the supply passage to prevent the supply of incorrect or unauthorized fluids to the reservoir. For example, in one embodiment, an access door (shown schematically at 72) may be provided over the external supply port 70. The access door 72 may include a locking or latching mechanism (e.g., mechanically, electromechanically, electronically), shown schematically at 73, to secure the access door 72 in a closed position covering the external supply port 70, for example, to prevent unauthorized access to the external supply port, and/or to prevent inadvertent or unintentional exposure of the supply port. In an exemplary embodiment (described in greater detail below), the spout portion of the dispenser may include an access door panel that is movable (e.g., slideable, pivotable) to expose an external supply port carried by the spout portion. The access door may be unlocked using a variety of arrangements, including, for example, a mechanical key or other insertable tool, a keypad entered combination code, or an RFID or other wireless unlocking code. In some embodiments, an unlocking element (e.g., code carrying RFID tag) may be carried by the external refill container, such that an authorized external refill container must be brought into proximity with the access door locking mechanism to open the access door. In other embodiments, the unlocking element may be a separate user-carried component (e.g., a mechanical key or electronic (e.g., RFID) key card.

In another embodiment, the external supply port 70 of the dispenser 20 may additionally or alternatively include a keyed, self-sealing connector (e.g., a keyed quick disconnect fitting member), shown schematically at 74, that connects with a corresponding keyed, self-sealing connector 94 on the external refill container 90, while preventing an open-flow connection with non-keyed or incorrectly keyed external containers. This arrangement would prevent a user from simply pouring refill fluid into the open or exposed external supply port 70 to refill the reservoir 30, or from supplying refill fluid from an unauthorized or incorrect (i.e., non-keyed or incorrectly keyed) container. The keying mechanism of the connectors may, for example, be mechanically, magnetically, or electromechanically operable.

In still another embodiment, an external refill container may include an electronic keying mechanism configured to transmit an authorized supply data signal to a controller in the dispenser, to initiate controller operation of a supply valve to permit the flow of refill fluid supplied to the external supply port to pass to the reservoir. In the schematically illustrated exemplary embodiment of FIG. 1, the dispenser 20 includes a supply valve 36 in circuit communication with the controller 50 and disposed along (and defining a portion of) the supply passage 35. The external refill container 90 includes a keying transmitter 95 configured to directly or indirectly transmit an authorized supply data signal to the controller 50 (e.g., to an antenna of the controller) of the dispenser 20, to identify the external refill container 90 as an authorized refill container. In response to receiving the authorized supply data signal, the controller 50 controls movement of the supply valve 36 from a closed position blocking flow from the external supply port 70 to the reservoir 30 to an open position permitting flow from the external supply port 70 to the reservoir 30.

An external refill container may utilize many different electronic keying mechanisms for communicating an authorized supply signal to the controller of the dispenser. In an exemplary embodiment, an RFID transponder tag 95 is located in or on the connector 94 of the container 90, and is arranged to transmit an authorized supply signal to a receiver 65 housed in the above deck spout portion 60 of the dispenser 20, with the receiver 65 being in wired or wireless circuit communication with the controller 50 disposed in the below deck housing 41. The proximity of the transponder tag 95 to the receiver 65 allows for the use of a passive RFID transponder tag, and the use of short range, low power RFID communication (e.g., Near Field Communication, Bluetooth® LE communication) between the transponder tag and the receiver. Further, the receiver may remain inactive (e.g., disconnected from a power source) until it is activated by a switch mechanism 75 triggered by opening the access door 72 to the external supply port 70, and/or connecting the external refill container connector 94 to the external supply port connector 74. Upon activation, the receiver 65 transmits an interrogation signal to the RFID transponder tag 95, and the transponder tag responds with transmission of the authorized supply data signal to the receiver 65. The receiver 65 transmits the authorized supply data signal to the controller 50 for evaluation of the data signal, and the controller actuates the supply valve to open the supply valve. The switch mechanism 75 may additionally or alternatively function to temporarily disable the dispensing mechanism 40, such that a person refilling the reservoir 30 does not unintentionally actuate the dispensing mechanism (e.g., due to proximity to sensor(s) of the user interface 80).

The authorization data signal may include one or more codes or other information that may be relevant to whether fluid from the corresponding container should be permitted to be supplied to the dispenser reservoir. For example, a unique serial code may be used to identify a specific batch of refill fluid being supplied, a product code may be used to identify the type of fluid stored in the refill container, and a distributor or manufacturer code may be used to identify the source of the fluid (e.g., to identify the supplier as an authorized distributor or manufacturer). A date code may identify the age of the fluid (e.g., to prevent refilling the dispenser with an expired fluid).

According to another aspect of the present application, the electronic keying mechanism 95 of the external refill container 90 may include a writeable memory storage device 96, such that the controller 50 may transmit to the keying transceiver 95, for storage in the memory storage device 96, additional usage information that may be relevant to future usage of the external refill container. As one example, where an external refill container is intended for a single use, the dispensing system may be configured such that once the external refill container has been connected to the dispenser to supply refill fluid to the dispenser, with the keying transceiver 95 placed in circuit communication with the dispenser controller 50, the dispenser controller transmits an invalidating data signal to the keying transceiver to write an invalidating code to (or to erase an authorization code from) the memory storage device, to prevent unauthorized re-use of the refill container 90. The disabled refill container may be configured to be recycled and reset by an authorized user or administrator by erasing the invalidating code or writing a new authorization code to the memory storage device.

As another example, where unauthorized refilling of the external refill container 90 is prohibited, the dispensing system may be configured such that the dispenser controller 50, through data signals received from a fill level sensor 55, determines a fill level of the refill container, or an amount of fluid supplied from the refill container into the reservoir 30, and writes to the writeable memory storage device 96 data corresponding to a current fill level of the refill container. In a subsequent use of the external refill container 30, a dispenser controller measurement indicating an increased refill container fill level provides an indication that the external refill container 90 has been improperly refilled. In response to identifying an improper refilling of the container, the controller 50 may provide an alert, locally (e.g., audible alarm tone, display panel warning light on the user interface 80) and/or remotely (e.g., cell phone text alert, alert transmission to a central computer system). Additionally or alternatively, the controller may temporarily (e.g., until an administrator reset or override is performed) disable the pumping mechanism 40 to prevent use of the dispenser 20, and/or maintain the supply valve 36 in the closed position to prevent further refilling of the reservoir 30. Still further, the controller 50 may transmit an invalidating data signal to the container's keying transceiver 95 to write an invalidating code to (or to erase an authorization code from) the container's memory storage device 96, to prevent subsequent use of the refill container 90.

Many different arrangements may be used to measure a fill level of the external refill container 90. As one example, the fill level of the external refill container may be measured directly, for example, by measuring the weight of the external refill container (and subtracting the known weight of the container itself). The weight of the external refill container may be measured using, for example, a strain gauge, force sensitive resistor, potentiometer, optic sensor, or other weighing sensor technology disposed on the external refill container or in the portion of the dispenser supporting the connected refill container (e.g., within the spout portion). The weight sensor may be configured to continuously or periodically measure the weight of the external refill container, or to measure the weight of the external refill container in response to specific refilling operations (e.g., when the external refill container is initially connected to the dispenser's external supply port prior to supplying fluid, and/or when the external refill container is initially disconnected from the dispenser's external supply port after supplying fluid). In one such embodiment, when the connector of the external refill container is initially connected with the connector of the dispenser's external supply port, the dispenser controller measures a current weight of the external refill container (based on data signals from the weight sensor) and compares the current weight to stored weight data from the refill container's memory storage device, to identify an improper refilling of the container indicated by an increase in the refill container weight (and to initiate one or more of the notification or disabling operations described above). When the connector of the external refill container is disconnected from the connector of the dispenser's external supply port (e.g., by pressing a release button on the dispenser spout portion, as described in greater detail below), the dispenser controller measures a current weight of the external refill container (based on data signals from the weight sensor) and writes current weight data to the refill container's memory storage device, which may replace the previously stored weight data.

In another embodiment, the fill level of the external refill container may be determined based on a known initial or previously determined refill container fill level, and an increase in the fill level of the reservoir as the external refill container supplies fluid to the reservoir, as being equivalent to the corresponding decrease in the refill container fill level. The weight of the reservoir may be measured using, for example, a strain gauge, force sensitive resistor, potentiometer, optic sensor, or other weighing sensor 55 disposed on the reservoir or on the below deck portion of the dispenser that supports the reservoir. The weight sensor 55 may be configured to continuously or periodically measure the weight of the reservoir 30 (e.g., taking into account known weights of the other dispenser components exerting a load on the weight sensor), or to measure the weight of the reservoir in response to specific refilling operations (e.g., when the external refill container 90 is initially connected to the dispenser's external supply port 70 prior to supplying fluid, and/or when the external refill container is initially disconnected from the dispenser's external supply port after supplying fluid). In one such embodiment, when the connector 94 of the external refill container 90 is initially connected with the connector of the dispenser's external supply port, the dispenser controller 50 begins frequent (e.g., once per second) measurements of the current weight of the reservoir (based on data signals from the weight sensor 55). The controller compares the change in the reservoir weight (due to added refill fluid) to stored weight data from the refill container's memory storage device 96 to identify an improper refilling of the container indicated by a reservoir weight increase that exceeds the previous refill container weight (and to initiate one or more of the notification or disabling operations described above). When the connector 94 of the external refill container 90 is disconnected from the connector 74 of the dispenser's external supply port (e.g., by pressing a release button on the dispenser spout portion, as described in greater detail below), the dispenser controller 50 measures a current weight of the reservoir 30 (based on data signals from the weight sensor 55) and writes current weight data to the refill container's memory storage device 96 corresponding to the previous refill container weight less the measured increase in the reservoir weight, with the current weight data replacing the previously stored weight data.

Monitoring the weight of the reservoir 30 may be useful to identify additional conditions of interest in the dispenser 20. As one example, a measured reservoir weight below a predetermined threshold may be used to identify a low fluid condition, for example, to provide a local or remote alert that a refill of the fluid is needed. In an exemplary embodiment, a user interface actuation of the dispensing mechanism triggers a controller reading of the weight sensor data to check for a below-threshold reservoir weight indicating a low fluid condition. In response to detection of the low fluid condition, the controller 50 initiates an alert notification (e.g., powering an LED indicator light on the user interface 80). As another example, an increase in the measured reservoir weight while the supply passage 35 is closed (e.g., closed access door 72, closed supply valve 36) and/or while no authorized supply data signal has been received would indicate that the supply passage 35 is being bypassed or otherwise tampered with to improperly refill the reservoir 30, for example, by injecting refill fluid directly into the reservoir or into the below deck portion of the supply passage (e.g., tubing or hose), often referred to as a "drill and fill" procedure. Upon identifying a drill and fill event, the controller 50 may initiate one or more of the notification or disabling operations described above.

Figure 11:
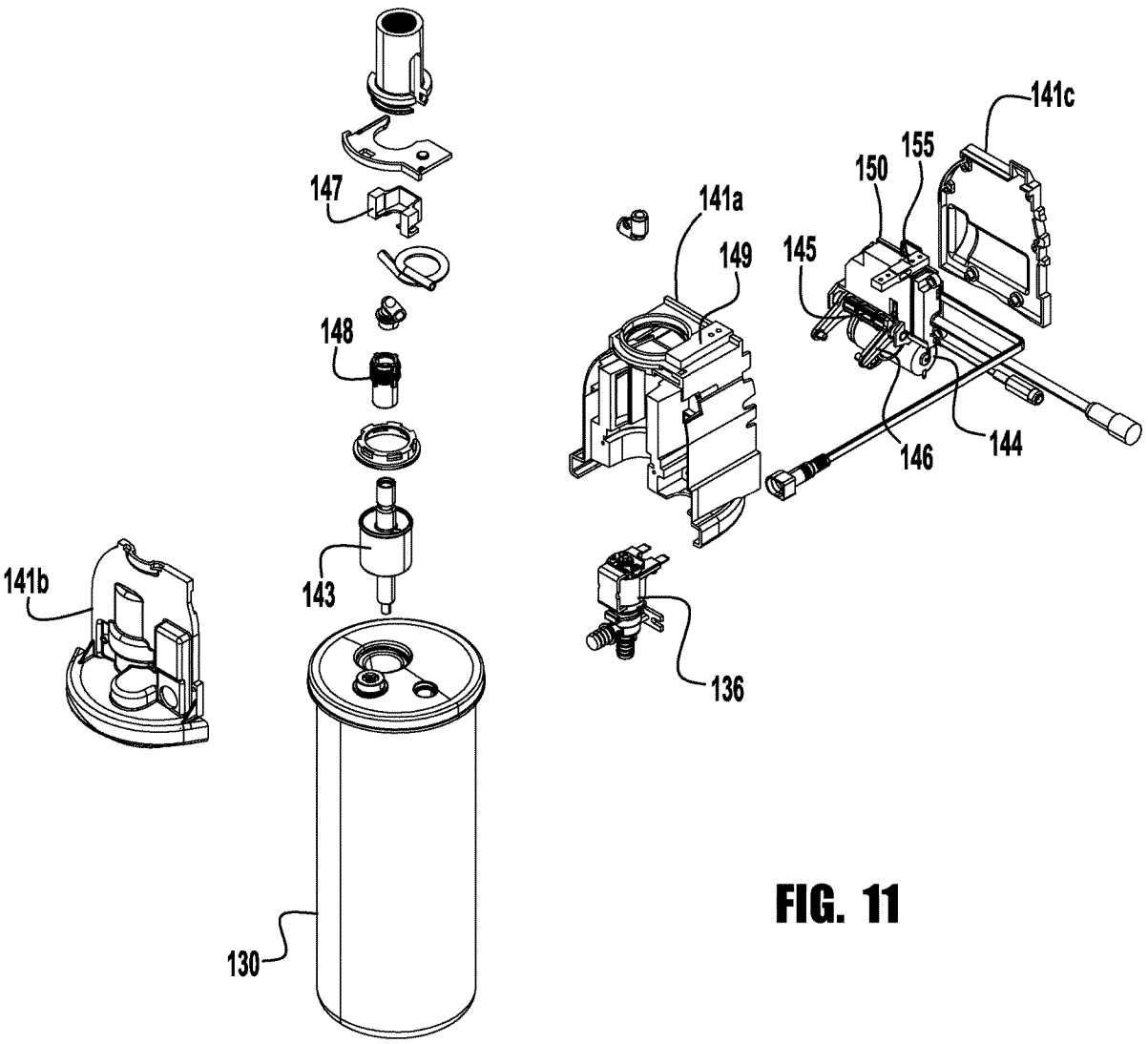
FIG. 11 is an exploded perspective view of the lower housing and reservoir portion of the fluid dispenser of FIG. 2.
Figure 13:
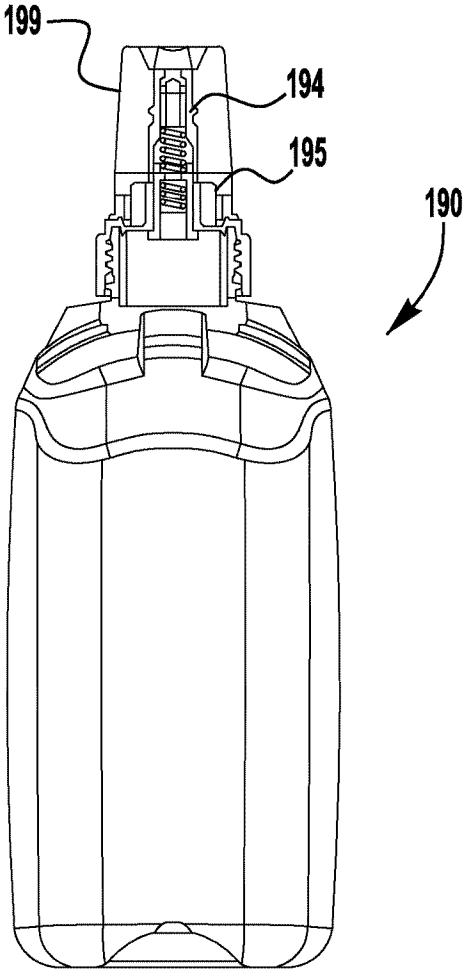
FIG. 13 is a side cross-sectional view of the refill container of FIG. 12.
Figure 12:
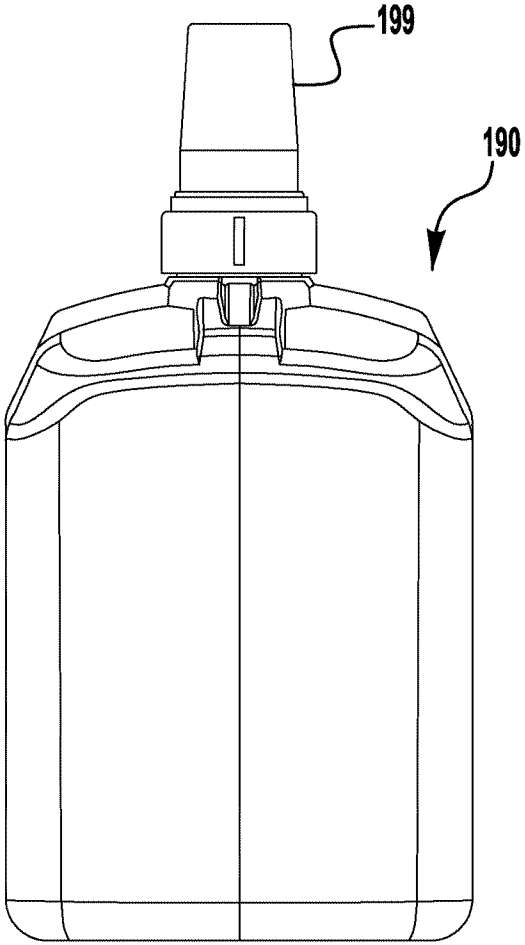
FIG. 12 is a front view of a refill container for use with an externally fillable fluid dispenser.
Figure 14:
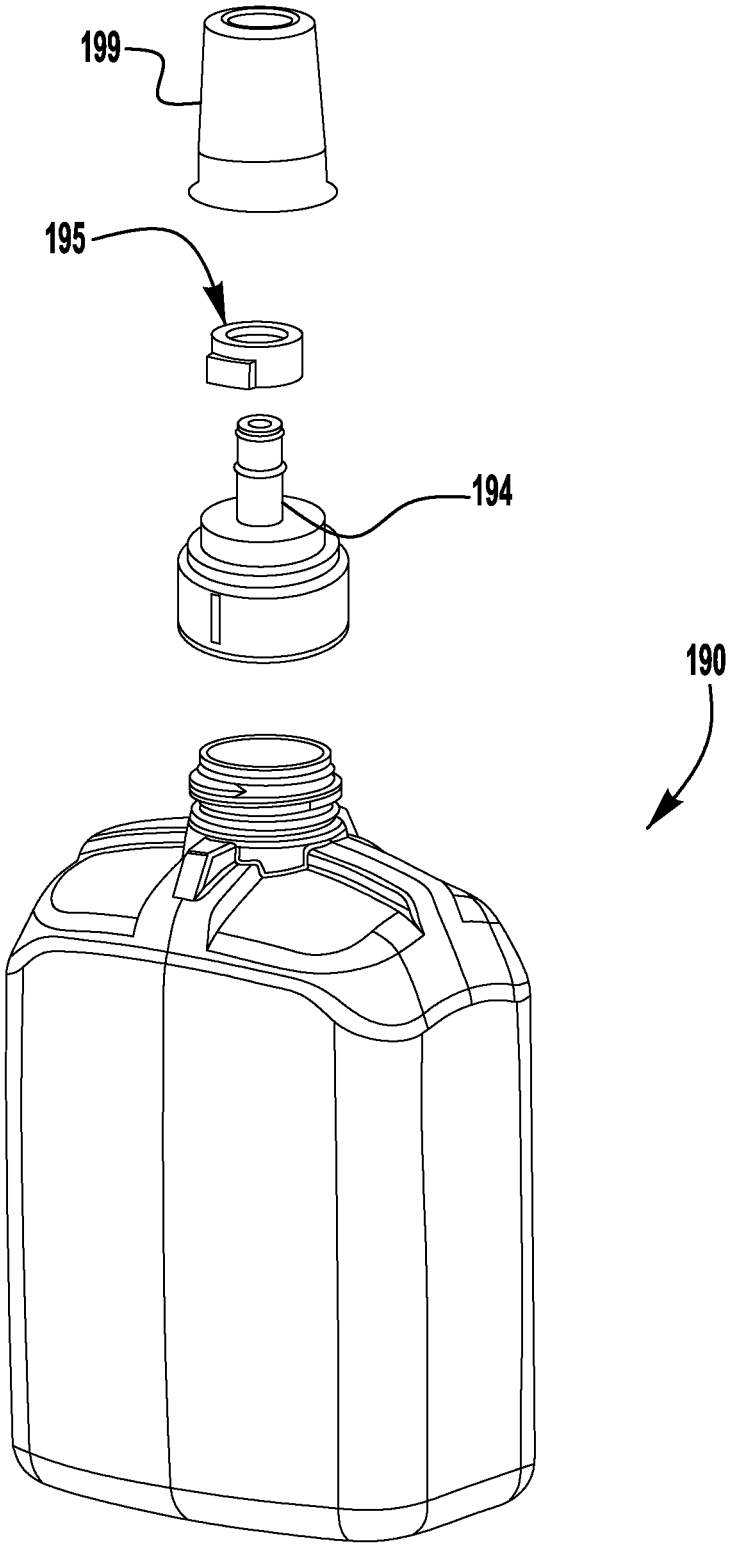
FIG. 14 is a partially exploded perspective view of the refill container of FIG. 12.

FIGS. 2-11 illustrate various views of an exemplary fluid dispenser 120 for use with an external refill container (e.g., the external refill container 190 of FIGS. 12-14, described in greater detail below). The exemplary dispenser 120 includes a below deck reservoir 130 and pump housing assembly 140 and an above deck spout 160 connected to the pump house assembly by a stem portion 168 that extends through a countertop C (e.g., of a sink or other structure).

Figure 7:
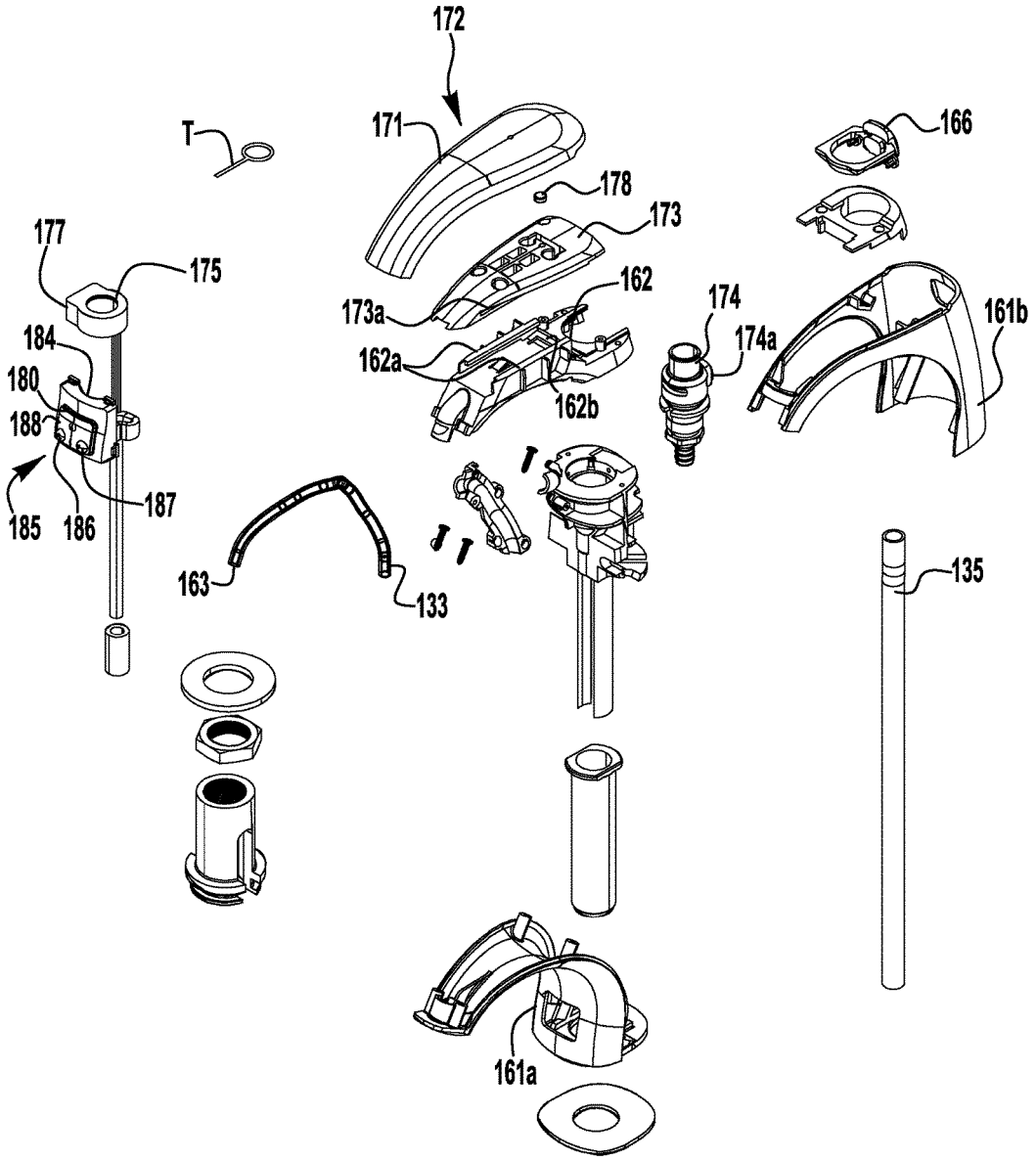
FIG. 7 is an exploded perspective view of the upper spout portion of the fluid dispenser of FIG. 2.
Figure 8:
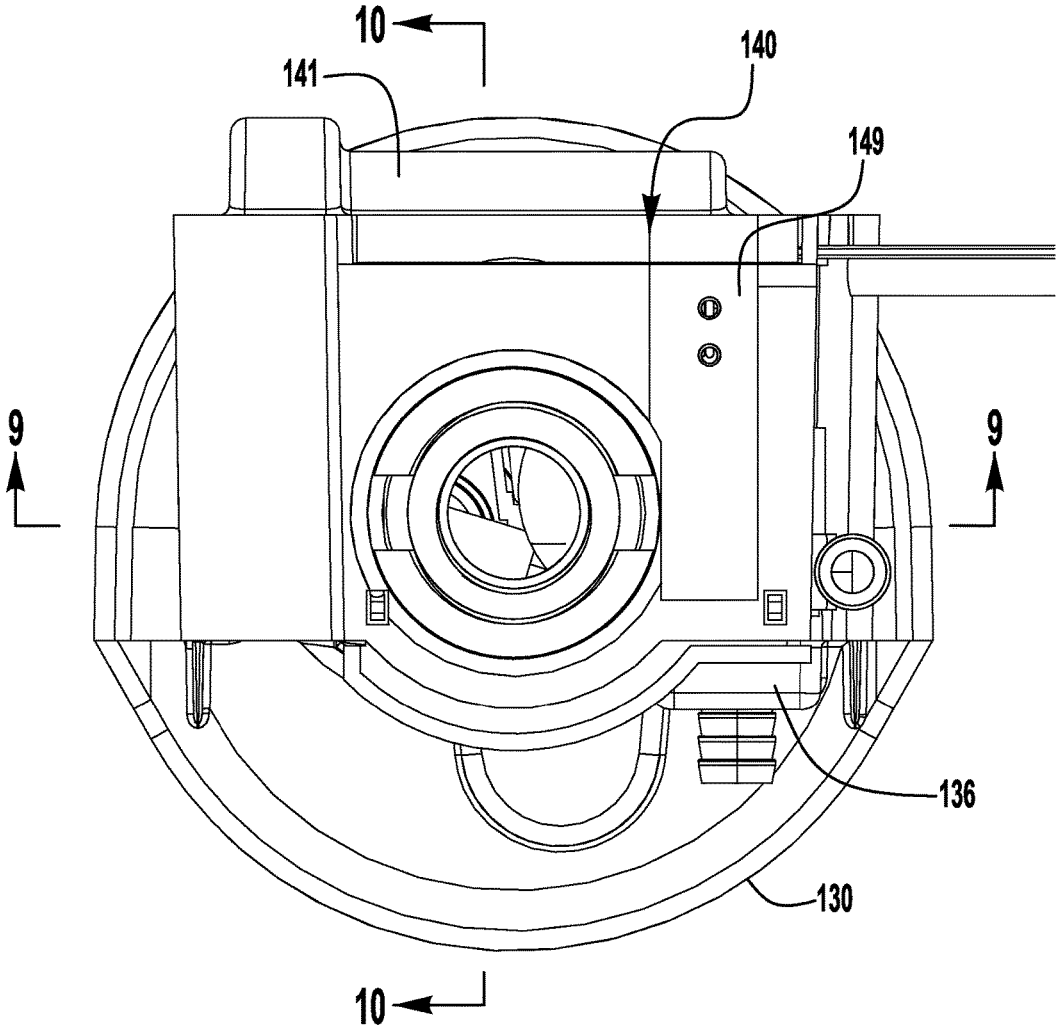
FIG. 8 is a top view of the lower housing and reservoir portion of the fluid dispenser of FIG. 2.
Figure 9:
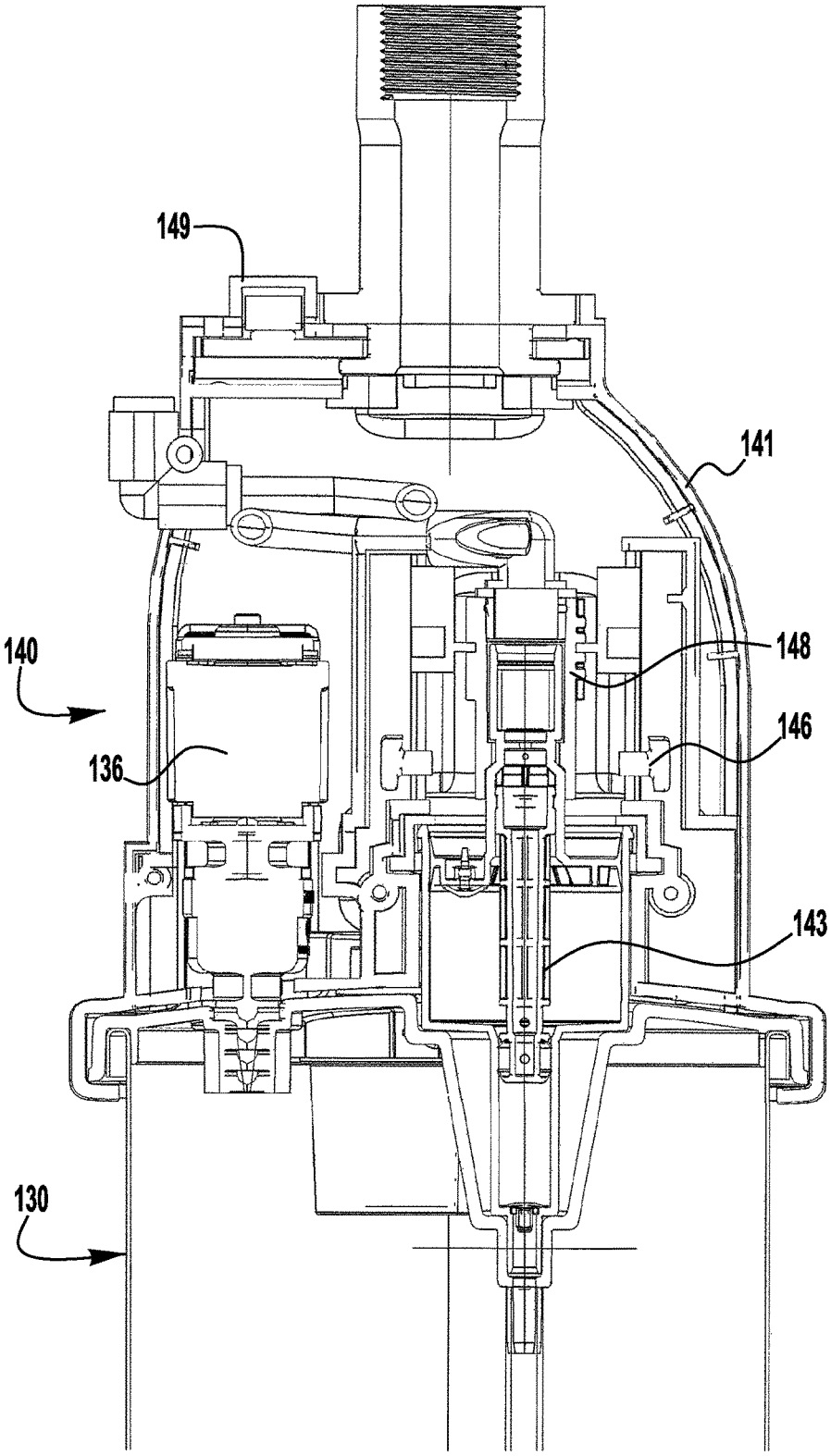
FIG. 9 is a side cross-sectional view of the lower housing and reservoir portion of the fluid dispenser of FIG. 2, taken along the line 9-9 of FIG. 8.
Figure 10:
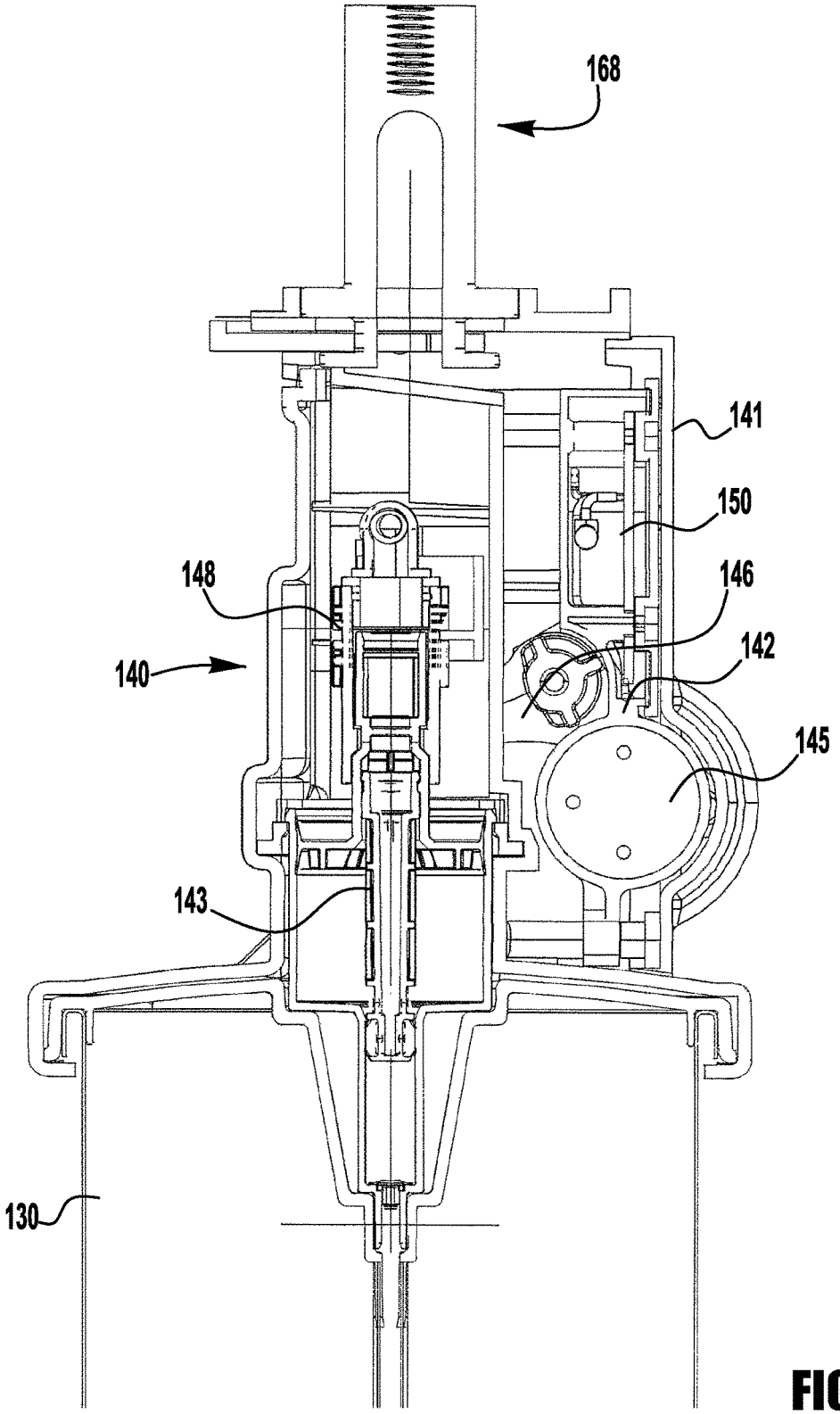
FIG. 10 is another side cross-sectional view of the lower housing and reservoir portion of the fluid dispenser of FIG. 2, taken along the line 10-10 of FIG. 8.

In the illustrated embodiment, an external supply port 170 (FIGS. 4-6) is disposed within the spout 160 and is concealed by an access door 172 assembled with the spout. The access door 172 forms an upper panel portion of the spout 160, such that the access door is flush with the other exterior surfaces of the spout when the access door is in a closed position. The access door 172 is slideable in a forward direction from the closed position to an open position exposing the external supply port 170. While many different structural arrangements may be used for a sliding access door mechanism, in the illustrated embodiment, as shown in FIG. 7, side recesses or tracks 173a in an access door insert 173 (attached to access door panel 171) slidingly interengage with side rails 162a of a spout body insert 162 (secured within a shell portion 161 of the spout 160). The access door 172 includes a latch 176, to secure the access door 172 in a closed position covering the external supply port 170 to prevent unauthorized access to the external supply port. A keyway 171*a* in the access door panel 171 allows insertion of a key or other tool T (e.g., paper clip) to release the latch 176 for movement of the access door 172. In the illustrated embodiment, the latch 176 includes a flexible tab 162*b* of the spout body insert 162 that is flexed out of engagement with a shoulder portion 173*b* of the access door insert when the tool T is inserted into the keyway 171*a* and pressed against the flexible tab 163*b*. In other embodiments (not shown), a bitted key or electronic/electromechanical locking mechanism may be utilized to provide increased security against unauthorized opening of the access door.

The external supply port 170 includes a quick disconnect socket 174 connected with a supply passage 135 extending to the reservoir 130. The quick disconnect socket 174 is configured for interlocking connection with a corresponding quick disconnect plug 194 disposed on the external refill container 190 (e.g., threaded onto an end port of the refill container, see FIG. 13), with the socket 174 and plug 194 self-sealing against fluid passage when disconnected. This self-sealing arrangement prevents a user from simply pouring refill fluid into the exposed external supply port (thereby preventing most incorrect or unauthorized fluid refill operations). While many different types of couplings may be used, in an exemplary embodiment, a polypropylene quick coupling type quick disconnect fitting arrangement based on, for example, model no. 60PPV-SE2-06 (manufactured by Link-Tech Quick Coupling, Inc.) is utilized. According to another aspect of the present application, a release button may be provided on the spout to facilitate disconnection of the socket and plug. In the illustrated embodiment, a release button 166 is disposed on a rear portion 161*b* of the spout shell portion 161 and is depressible to engage a spring-loaded release button 174*a* on the quick disconnect socket 174 for detachment of the refill container quick disconnect plug 194. The refill container 190 may include a removable cap 199 to cover the quick disconnect plug 194 when the refill container is not in use.

To further safeguard against the supplying of incorrect or unauthorized refill fluid to the reservoir 130, the pump housing assembly 140 of the dispenser 120 includes a supply valve 136 disposed along, and defining a portion of, the supply passage 135. When the supply valve 136 is in the closed position, a refill fluid supplied to the external supply port 170 is blocked within the supply passage 135 by the closed supply valve, even when supplied by a refill container having the correct quick disconnect plug or other such keyed connector. To open the supply valve 136 and permit the supplying of refill fluid from the refill container 190 to the reservoir 130, the refill container is provided with an electronic keying mechanism that communicates authorization data to a dispenser controller 150 disposed in the pump housing 141 (formed by housing members 141*a*, 141*b*, 141*c*, as shown in FIG. 11), which opens the supply valve 136 in response to verification of the authorization data.

In the illustrated embodiment, a collar-shaped RFID transceiver 195 is assembled with the quick disconnect plug 194 of the refill container 190, and is positioned for short range, low power RFID communication (e.g., Near Field Communication) with a corresponding RFID transceiver 165 disposed in the external supply port 170. The supply port transceiver 165 receives refill container data (e.g., corresponding to supplier identifying distributor codes, fluid and/or container identifying serial numbers, and fluid fill level data) from the refill container transceiver 195, and transmits this data (e.g., by wired circuit communication) to the controller 150. Once the controller 150 verifies that the refill container 190 is from the correct supplier (e.g., by verifying the distributor code stored in the memory of the transceiver), contains the correct fluid (e.g., by verifying the serial number or product code stored in the memory of the transceiver), and/or contains sufficient fluid for refilling (e.g., by checking the fluid fill level data stored in the memory of the transceiver), the controller 150 initiates actuation of the supply valve 136 from a closed position blocking flow from the quick disconnect socket 174 to the reservoir 130 to an open position permitting flow from the quick disconnect socket 174 to the reservoir 130.

Many different types of electrically actuated supply valves may be utilized. In the illustrated embodiment, the supply valve 136 is a solenoid actuated two-way shutoff valve. One such example is a two-way diaphragm shutoff miniature "nano" valve actuated by a latching 6 VDC solenoid (manufactured by RPE Ltd. in Carbonate, Italy).

To trigger RFID communication when the access door 172 is opened (e.g., to prevent continuous power consuming RFID transmissions from the supply port transceiver when the supply port is not in use), the supply port transceiver 165 includes a reed switch 177 (see FIGS. 6 and 7) that is held in an open condition by a magnet 178 (FIG. 7) installed in the access door 172 when the access door is in the closed position. When the access door 172 is moved to the open position, the reed switch 177 closes to activate the supply port transceiver 165 for communication of an interrogation signal to the refill container transceiver 195, and for receipt of a response transmission of the authorized supply data signal from the refill container transceiver 195. The supply port transceiver 165 transmits the authorized supply data signal to the below deck controller 150 for evaluation of the data signal, and the controller 150 actuates the supply valve 136 to open the supply valve in response to confirmation that the authorized supply data signal corresponds to an authorized refill container.

The reed switch 177 may additionally or alternatively function to temporarily disable the dispensing mechanism 142, such that a person refilling the reservoir 130 does not unintentionally actuate the dispensing mechanism (e.g., due to proximity to sensor(s) of the user interface 180).

The refill container transceiver 195 includes a writeable memory storage device (not shown), such that the below deck controller 150 may transmit (through the supply port transceiver 165) to the refill container transceiver 195, for storage in the memory storage device, additional usage information that may be relevant to future usage of the external refill container 190. As discussed above, data transmitted to the refill container transceiver 195 for storage in the memory storage device may include, for example, fill level data based on the weight change of the dispenser reservoir 130 while the external refill container 190 is connected with the supply port 170 (e.g., as determined by wireless communication between the supply port transceiver 165 and the refill container transceiver 195), or an invalidating code in response to an indication that the external refill container has been improperly reused and/or refilled.

In the illustrated embodiment of FIGS. 2-11, the fill level of the external refill container 190 is determined based on a known initial or previously determined refill container fill level, and an increase in the fill level of the reservoir 130 as the external refill container 190 supplies fluid to the reservoir, as being equivalent to the corresponding decrease in the refill container fill level. The weight of the reservoir 130 is measured using a strain gauge 155 (FIG. 11) having a bottom surface mounted at a first end to a mounting block portion 149 of the pump housing 141 and a top surface to be mounted at a second end to an underside of the counter. The strain gauge 155 includes strain sensing wires (not shown) that bend with the beam shaped strain gauge body as the weight of the reservoir 130 increases, causing a change in the resistance of the wires. These changes in resistance are correlated to weight values by the below deck controller 150.

When the connector 194 of the external refill container 190 is initially connected with the connector of the dispenser's external supply port, the dispenser controller 150 begins frequent (e.g., once every second) measurements of the current weight of the reservoir (based on data signals from the strain gauge 155). The controller compares the change in the reservoir weight (due to added refill fluid) to stored weight data from the refill container's memory storage device to identify an improper refilling of the container indicated by a reservoir weight increase that exceeds the previous refill container weight (and to initiate one or more of the notification or disabling operations described above). After each weight sensor measurement (e.g., once every second) the controller 150 may transmit the weight data to the refill container's memory storage device for storage of refill container weight data corresponding to the previous refill container weight less the measured increase in the reservoir weight, with the current weight data replacing the previously stored weight data. Alternatively, the weight data may be transmitted to the refill container less frequently, such as, for example, only when the refill procedure has completed. For example, when the connector 194 of the external refill container 190 is disconnected from the connector 174 of the dispenser's external supply port 170, by pressing the release button 166 on the dispenser spout portion 160, the dispenser controller 150 may be triggered or activated to measure a current weight of the reservoir 130 (based on data signals from the strain gauge 155) and transmits current weight data to the refill container's memory storage device corresponding to the previous refill container weight less the measured increase in the reservoir weight, with the current weight data replacing the previously stored weight data.

The pump housing assembly 140 includes a pump mechanism 142 disposed in the pump housing 141. While many different types of pump mechanisms may be utilized, in the illustrated embodiment, the pump mechanism includes a piston displacement pump 143 (e.g., a piston displacement foaming pump) actuated by a gear motor 144 that drives a cam 145 to rotate an actuator arm member 146 which reciprocates to actuate a lift member 147 secured with an outlet member 148 of the pump 142. The motion is terminated by an end-of-stroke switch (not shown).

A touch free sensor-based user interface 180 is disposed on a front portion 161*a* the spout shell 161. The exemplary user interface 180 includes a touch free sensor arrangement 185, with an infrared light emitting diode 186 and light detecting photo diode 187 that senses changes in the reflected light resulting from positioning of a user's hand under the spout. A microcontroller 184 in the user interface transmits an actuation signal to the below deck controller 150 to initiate operation of a pump motor, described in greater detail below. The pump mechanism may be activated within a brief predetermined time period (e.g., about 200 ms) after the user's hand passes within a detection range (or activation zone) of the sensor arrangement 185, to dispense a predetermined dose of fluid in the user's hand. To prevent excess dispensing of fluid, the user interface microcontroller may be configured to require an empty activation zone for a predetermined time period (e.g., about 0.12 seconds) before transmitting a new actuation signal in response to a subsequent detection of a user's hand in the activation zone. The user interface may further include a maintenance indicator light 188 to provide an indication of a dispenser condition requiring attention (e.g., low fluid, low battery, tampering indication).

The below deck controller 150 is in circuit communication with the user interface 180 and the pump mechanism 142. When the controller 150 receives an actuation signal from the user interface 180 (e.g., corresponding to detection of a user's hand in proximity with the sensor arrangement 185), the controller initiates operation of the pump mechanism 142 to dispense fluid from the reservoir 130 through the dispense passage 133 to the outlet port 163. Actuation of the pump mechanism 142 may also trigger a strain gauge 155 measurement of the fluid fill level, to check for a below-threshold reservoir weight indicating a low fluid condition. In response to detection of the low fluid condition, the controller 150 initiates an alert notification (e.g., powering an LED indicator light on the user interface 180). The controller 150 may also compare the measured reservoir weight to a most recent measured reservoir weight. An increase in the measured reservoir weight while the supply passage 135 is closed (e.g., closed access door 172, closed supply valve 136) and/or while no authorized supply data signal has been received would indicate that the supply passage 135 is being bypassed or otherwise tampered with to improperly refill the reservoir 130. Upon identifying such an event, the controller 150 may initiate one or more of the notification or disabling operations described above.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A fluid dispensing system comprising:

a counter mountable fluid dispenser comprising:

a below deck reservoir for storing a fluid;

an above deck spout including an outlet port at a front portion of the spout, the outlet port being in fluid communication with the reservoir for dispensing fluid stored in the reservoir, and an external supply port at a rear portion of the spout, with the external supply port including a quick disconnect socket connected with the reservoir by a supply passage to supply fluid to the reservoir; and an access door assembled with the spout, the access door being movable between a closed position blocking access to the external supply port and an open position permitting access to the external supply port; and an external refill container for storing a refill fluid, the external refill container including a quick disconnect plug connectable with the quick disconnect socket;

wherein the spout includes a release button disposed on an outer surface of the spout, the release button being depressible to disengage the quick disconnect plug from the quick disconnect socket.

2. The fluid dispensing system of claim 1, wherein the access door is slideable in a forward direction from the closed position to the open position.

3. The fluid dispensing system of claim 1, wherein the spout further includes a latching mechanism securing the access door in the closed position.

4. The fluid dispensing system of claim 3, wherein the latching mechanism comprises a flexible tab on the spout that interlocks with a portion of the access panel, the access panel including an aperture sized and positioned for insertion of a tool through the aperture to disengage the flexible tab from the access panel.

5. The fluid dispensing system of claim 1, further comprising a dispensing mechanism in fluid communication with the reservoir, and a switch mechanism configured to disable the dispensing mechanism when the access door is in the open position.

6. The fluid dispensing system of claim 1, wherein the access door defines an entire upper surface of the spout.

7. The fluid dispensing system of claim 1, wherein the release button is depressible to engage a release button disposed on the quick disconnect socket.

8. A counter mountable fluid dispenser comprising:

a below deck reservoir for storing a fluid;

an above deck spout including an outlet port at a front portion of the spout, the outlet port being in fluid communication with the reservoir for dispensing fluid stored in the reservoir, and an external supply port at a rear portion of the spout, with the external supply port including a quick disconnect socket connected with the reservoir by a supply passage to supply fluid to the reservoir, the quick disconnect socket being configured to connect with a quick disconnect plug of an external refill container; and an access door assembled with the spout, the access door being movable between a closed position blocking access to the external supply port and an open position permitting access to the external supply port;

wherein the spout includes a release button disposed on an outer surface of the spout, the release button being depressible to disengage the quick disconnect socket from a connected quick disconnect plug.

9. The fluid dispenser of claim 8, wherein the access door is slideable in a forward direction from the closed position to the open position.

10. The fluid dispenser of claim 8, wherein the spout further includes a latching mechanism securing the access door in the closed position.

11. The fluid dispenser of claim 10, wherein the latching mechanism comprises a flexible tab on the spout that interlocks with a portion of the access panel, the access panel including an aperture sized and positioned for insertion of a tool through the aperture to disengage the flexible tab from the access panel.

12. The fluid dispenser of claim 8, further comprising a dispensing mechanism in fluid communication with the reservoir, and a switch mechanism configured to disable the dispensing mechanism when the access door is in the open position.

13. The fluid dispenser of claim 8, wherein the access door defines an entire upper surface of the spout.

14. The fluid dispenser of claim 8, wherein the release button is depressible to engage a second release button disposed on the quick disconnect socket.

15. A method of filling a below deck reservoir of a fluid dispenser having an above deck spout, the method comprising:

moving an access door assembled with the spout from a closed position blocking access to an external supply port in the spout to an open position permitting access to the external supply port, the external supply port being in fluid communication with the reservoir;

connecting a quick disconnect plug on an external refill container with a quick disconnect socket of the external supply port;

pouring refill fluid from the external refill container into the external supply port to refill the reservoir;

pressing a release button on the spout to disengage the quick disconnect plug from the quick disconnect socket; and moving the access door to the closed position.

16. The method of claim 15, wherein moving the access door from the closed position to the open position comprises sliding the access door in a forward direction.

17. The method of claim 15, further comprising disengaging a latching mechanism securing the access door in the closed position prior to moving the access door to the open position.

18. The method of claim 17, wherein disengaging the latching mechanism comprises inserting a tool through an aperture in the access door.

19. The method of claim 15, wherein moving the access door to the open position operates a switch mechanism to disable a dispensing mechanism of the fluid dispenser.

20. The method of claim 15, wherein pressing the release button engages a second release button disposed on the quick disconnect socket.

* * * * *